US006260322B1

(12) United States Patent
Lindsay

(10) Patent No.: US 6,260,322 B1
(45) Date of Patent: Jul. 17, 2001

(54) COMPOSITE FLOOR SYSTEM FOR BUILDING STRUCTURE

(76) Inventor: Fredrick H. Lindsay, 9393 - 120th La. North, Seminole, FL (US) 34642

( * ) Notice: Subject to any disclaimer, the term of this patent is extended or adjusted under 35 U.S.C. 154(b) by 0 days.

(21) Appl. No.: 09/564,464

(22) Filed: May 3, 2000

Related U.S. Application Data

(60) Provisional application No. 60/134,571, filed on May 17, 1999.

(51) Int. Cl.[7] ..... E04B 9/00; E06B 3/54

(52) U.S. Cl. ..... 52/474; 52/650.3; 52/650.2; 52/650.1; 52/653.1; 52/309.9

(58) Field of Search ..... 52/474, 480, 143, 52/209.9, 483.1, 653.1, 650.1, 650.2, 650.3, 690, 262, 263

(56) References Cited

U.S. PATENT DOCUMENTS 3,878,658 * 4/1975 Davis et al. ..... 52/410
4,962,612 * 10/1990 Kuwano et al. ..... 52/506
6,044,610 * 4/2000 DeVon et al.. ..... 52/653.1

* cited by examiner

*Primary Examiner*—Carl D. Friedman
*Assistant Examiner*—Chi Nguyen
(74) *Attorney, Agent, or Firm*—Frijouf, Rust & Pyle, P.A.

(57) ABSTRACT

The invention is incorporated into a composite floor system for a building structure comprising a plurality of major transverse beams and a minor transverse beam. The major transverse beam has a greater vertical height than the minor transverse beam. The minor transverse beam is interposed between adjacent major transverse beams. A composite panel having an upper sheet member and a lower sheet member is positioned between adjacent major transverse beams with the major transverse beams supporting the upper sheet member and with the interposed minor transverse beam supporting the lower sheet member. A fastener affixes the composite panel to one of the transverse beams.

19 Claims, 8 Drawing Sheets

COMPOSITE FLOOR SYSTEM FOR BUILDING STRUCTURE

CROSS-REFERENCE TO RELATED APPLICATIONS

This application claims benefit of United States Patent Provisional application Ser. No. 60/134,571 filed May 17, 1999. All subject matter set forth in provisional application Ser. No. 60/134,571 is hereby incorporated by reference into the present application as if fully set forth herein.

BACKGROUND OF THE INVENTION

1. Field of the Invention

This invention relates to building structures and more particularly to an improved composite floor system for a building structure such as a manufactured home or the like.

2. Prior Art Statement

Various systems have been devised in the prior art for providing a frame for a building structure such as a manufactured home or the like. The frame is one of the most important elements of a manufactured home. The frame must be strong in order to transport the manufactured home from the manufacturing plant to the permanent site. In many cases, a transportation wheel assembly is affixed to the frame enabling a truck to tow the manufactured home to the ultimate destination. Thereafter, the frame was required to support the building structure on a foundation.

Many building structures such as a manufactured home or the like incorporate plural longitudinally extending beams spaced apart in a parallel relationship. A plurality of transverse beams rest upon the plural longitudinally extending beams in a parallel relationship. A floor sheet material is affixed to the plurality of transverse beams resting upon the plural longitudinally extending beams. A flexible insulating material is affixed to an underside of the plurality of transverse beams. Unfortunately, the flexible insulating material affixed to the underside of the plurality of transverse beams was subject to damage by diverse causes.

A number of unique flooring systems for building structures such as manufactured homes and the like have been devices in the prior art. Many of these unique flooring systems for building structures are set forth in my prior United States Patents.

U.S. Pat. No. 3,716,267 to Lindsay discloses a unified floor and frame assembly with a skirt for a mobile building. The floor and frame assembly has a pair of parallel I-beams which extend the length of the building being mounted atop a plurality of parallel beams extending the width of the building. A plurality of parallel members aligned with the lower beams are mounted atop the pair of beams and are supported by vertical legs. Floor sheets are mounted atop a plurality of ribs that extend the length of the building being recessed in the members. The lower beams form ledges that receive and support the building side walls. A wheeled carriage is removably connected to tubes mounted beneath the floor-frame assembly for transportation of the building. Skirts are fastened to the building side walls and extend to the bottom end of the unified floor-frame assembly.

U.S. Pat. Nos. 4,015,375 and 4,019,299 to Lindsay discloses an improved floor frame assembly incorporated into a mobile building. A pair of identical frame assemblies form the floor of the building each including a plurality of middle beams mounted to and atop lower beams and further including a pair of adjacent interior sidewalls attached to the middle beams and extending therebeneath being adjacent the lower beams. The exterior sidewalls are mounted to the frame assemblies. Wheeled carriages are removably mountable to the assemblies facilitating transportation of the assemblies to a building site. A skirt is permanently mounted externally to the sidewalls and extends adjacent the floor assembly. A bracket is connected to the middle beam and the bottom beam of each frame assembly and in addition is connected to a pole that supports the adjacent middle portions of the frame assemblies. The interior sidewalls are slidably received in the bracket. In an alternate embodiment, the floor frame assembly is incorporated into a floor joist.

U.S. Pat. No. 4,106,258 to Lindsay discloses a composite wood and steel joist assembly in which steel channel members form a U-shaped configuration with inwardly extending portions formed at the free ends of the legs. The steel channel members forming this configuration have their open sides facing outwardly. Wooden members of rectangular cross-sectional configuration are inserted and secured within the bight of the channel members so that wood surfaces, accepting wood fasteners such as nails or staples, are presented outwardly around the complete perimeter of the joist assembly.

U.S. Pat. No. 4,863,189 to Lindsay discloses a floor frame assembly, formed principally of wood material, having two load-bearing outer beams and front and rear end members defining a periphery and a plurality of transverse load-supporting trusses connected normal to the outer beam between the end members. In a preferred embodiment, each truss has an upper elongate member, a shorter central elongate member attached parallel thereto by vertical cross-braced elements, and on either side of the central member a braced vertical member spaced therefrom to provide gaps of predetermined height and width. Each truss also has an end portion of the upper elongate member in cantilever form for contact thereat with a load-supporting surface at the permanent location of the floor assembly, so that additional external beams or continuous wall surfaces to support the completed floor frame assembly and any superstructure thereon is rendered unnecessary. The floor frame assembly may be further supported by conventional piers or jackposts at points under two elongate, load-supporting, inner beams closely received and connected to the trusses within the gaps. These inner beams may optionally be made of a wood material supported along the edges at selected portions by metal reinforcement, or entirely formed of I-section beam lengths. In one aspect of the invention, at least one of the load-supporting outer beams has a larger vertical dimension than the other outer beam. The two floor frame assemblies may be united at their respective wider outer beams to provide additional support thereunder to generate a conmensurately larger floor frame assembly structure.

U.S. Pat. No. 4,930,809 to Lindsay discloses a unified floor frame assembly having two elongate outer load supporting beams formed of elongate beam sections that are butt-spliced to be cambered in parallel vertical planes to counter forces that may tend to cause sagging of the floor frame assembly during transportation. At inner vertical perimeter surfaces of the elongate beams are provided attachment plates for attachment, first, of a wheel carrier assembly detachably mountable thereto with a plurality of wheels partially recessed within the floor frame assembly and, second, a towing hitch assembly attachable to a forward end of the floor frame assembly for applying a towing force thereat. A moisture, dirt, insect and pest excluding thin covering is provided underneath the floor frame assembly and sections of heating and ventilating ducting, piping, wiring and the like are includable during manufacture of the floor frame assembly. Individual floor frame assemblies may be supported at their permanent location underneath the periphery or, where two such floor frame assemblies are to be coupled to obtain a larger size floor, central elongate beams may be supported by metal posts. Upon delivery of the floor frame assembly to its intended location, the wheel carrier assembly and the towing hitch assembly are both detached and removed therefrom for reuse.

U.S. Pat. No. 5,028,072 to Lindsay discloses a unified floor frame assembly having two elongate outer load-supporting beams formed of wooden elongate beam sections that may be selected to have different vertical cross-sectional dimensions and, optionally with two thicknesses united, are butt-spliced to be cambered in parallel vertical planes to counter forces that may tend to cause sagging of the floor frame assembly during transportation. A wheel carrier assembly is detachably mountable thereto with a plurality of wheels partially recessed within the floor frame assembly and a towing hitch assembly is attachable to a forward end of the floor frame assembly for applying a towing force thereat. Wooden I-beams are used as transverse frame members to provide lightweight strength and floor frame widths of the order of 18 ft. to 20 ft. A moisture, dirt, insect and pest excluding thin covering is provided underneath the floor frame assembly, and sections of heating and ventilating ducting, piping, wiring and the like are includable during manufacture of the floor frame assembly. Individual floor frame assemblies may be supported at their permanent location underneath the periphery or, where two such floor frame assemblies are to be coupled to obtain a larger size floor, central elongate beams may be supported by metal posts. Upon delivery of the floor frame assembly to its intended location, the wheel carrier assembly and the towing hitch assembly are both detached and removed therefrom for reuse.

U.S. Pat. No. 5,201,546 to Lindsay discloses a towable unified floor frame assembly derived length-wise strength from two elongate I-beams disposed symmetrically about a longitudinal axis. The I-beams are separated by a plurality of angle-sectioned metal cross members welded therebetween. A plurality of trusses, corresponding in number and location to the metal cross members, is disposed to support an outer perimeter and a floor thereabove. Each truss incorporated upwardly inclined bracing elements located outwardly of the I-beams connected to flat metal connection elements individually unified to the I-beams, preferably by welding. A waterproof and dirt-excluding cover entirely covers the underneath of the floor frame assembly. Heating and ventilating ducts, power and telephone wires, water and waste pipes, thermal insulation and the like, are installed within the floor frame assembly. The entire floor frame assembly, and any superstructure built thereon, may be readily towed to a selected location on a plurality of wheels detachably mounted to brackets provided underneath the I-beams, a towing force being applied by a forwardly disposed detachable towing hitch. The floor frame assembly and its superstructure to rest on the wheels and a jack supporting the towing hitch or, optionally, may be supported underneath the I-beams by externally provided support elements.

U.S. Pat. No. 5,448,809 to Lindsay discloses a lightweight, strong, economically-manufactured, and safely transportable modular unified floor assembly includes a lengthwise wooden girder beam formed with male and female ends to facilitate cooperative integration thereby to another similar floor assembly. In another aspect of the invention, the floor assembly is manufactured with a stairwell opening of selected size and at a selected location. The floor assembly even with a stairwell opening according to this invention is strong enough to be transported comfortably and safely from its point of manufacture to the site at which it is to be located for use.

Insulating composite panels have been used for many years in the building industry. The composite panels have been used for walls and roofs of building structures. Typically, the insulating composite panels comprise a lamination of a substantially rigid insulating material interposed between a first and a second sheet material. The substantially rigid insulating material is a substantially rigid close cell foam such as a styrofoam or the like. The first and second sheet materials are plywood or some equivalent structure that is adhesively affixed to opposed sides of the substantially rigid insulating foam.

The intermediate insulating foam is undercut relative to the first and second sheet materials for allowing single or plural wood beams to be received within a recess between the first and second sheets. The composite panels were assembled by placing a plurality of panels adjacent to one another with single or plural beams received within adjacent recesses in adjacent panels.

The use of composite panels has been effective for wall panels. However, the use of composite panels for flooring or for roofing has not found widespread use in the art.

It is a primary object of the present invention to incorporate the superior design of my prior United States Patents to incorporate and use composite panels for flooring and roof structures.

Another object of this invention is to provide a composite insulated floor system for a building structure that adds to the mechanical strength of the building structure.

Another object of this invention is to provide a composite insulated floor system for a building structure that is designed to add to the structural strength of the floor of the building structure.

Another object of this invention is to provide a composite insulated floor system for a building structure that provides an insulating flooring or a insulating roof structure.

Another object of this invention is to provide a composite insulated floor system for a building structure that provides a light weight insulating flooring or a insulating roof structure.

Another object of this invention is to provide a composite insulated floor system for a building structure that is adaptable to a floor of the building structure or a roof of the building structure.

Another object of this invention is to provide a composite insulated floor system for a building structure that provides a substantial saving in labor costs.

Another object of this invention is to provide a composite insulated floor system for a building structure which provides a substantial saving in assembly time which may provide a manufactured hone with walls, floor and roof incorporating insulating composite panels.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to a composite floor system for a building structure comprising a plurality of major transverse beams and a minor transverse beam. Each of the major transverse beams has a greater vertical height than the minor transverse beam. The minor transverse beam is interposed between adjacent major transverse beams. A composite panel having an upper sheet member and a lower sheet member is positioned between adjacent major transverse beams with the major transverse beams supporting the upper sheet member and with the interposed minor transverse beam supporting the lower sheet member. A fastener affixes the composite panel to one of the transverse beams.

In a more specific embodiment of the invention, the composite panel defines a panel thickness between the upper sheet member and lower sheet member. The vertical height of each of the major transverse beams is greater than the vertical height of the minor transverse beam by an amount commensurate with the panel thickness of the composite panel.

In one embodiment of the invention, the composite panel includes an insulating intermediate member interposed between the upper sheet member and the lower sheet member. The insulating intermediate member is a substantially rigid foam insulation member. The upper sheet and the lower sheet is adhesively bonded to the intermediate insulating member to form a lamination.

Preferably, the upper sheet member of the composite panel overhangs adjacent sides of the lower sheet member for enabling the upper sheet member to rest upon the adjacent major transverse beams. The fastening means comprises a plurality of mechanical fasteners affixing the upper sheet member to the adjacent major transverse beams. Preferably, the fastening means comprises a plurality of nail fasteners for affixing the upper sheet member to the adjacent major transverse beams.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
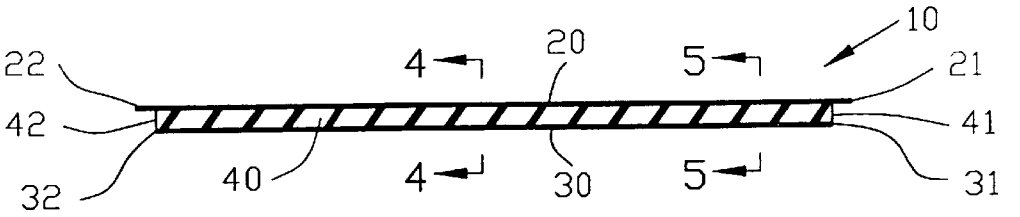
FIG. 1 is a side view of a composite panel for the composite insulated floor system of the present invention.
Figure 2:
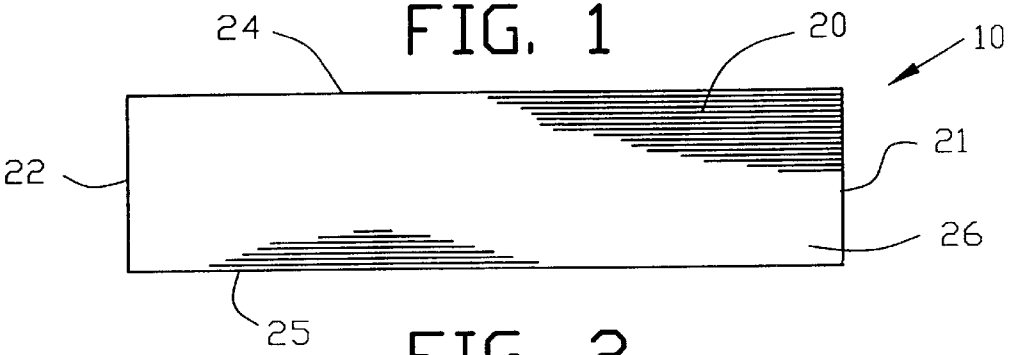
FIG. 2 is a top view of FIG. 1.
Figure 3:
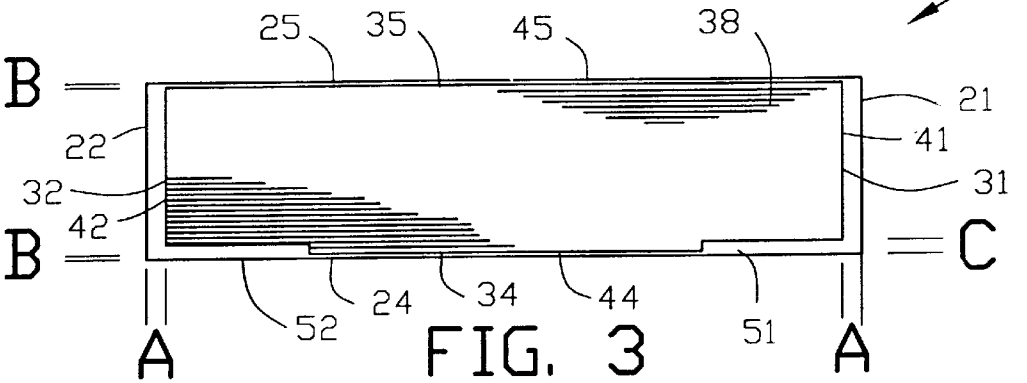
FIG. 3 is a bottom view of FIG. 1.

FIGS. 1–3 are side, top and bottom views of a composite panel 10 for the composite insulated floor system of the present invention. The composite panel 10 comprises an upper sheet member 20 and a lower sheet member 30 with an insulating intermediate member 40 interposed between the upper sheet member 20 and the lower sheet member 30.

Figure 4:
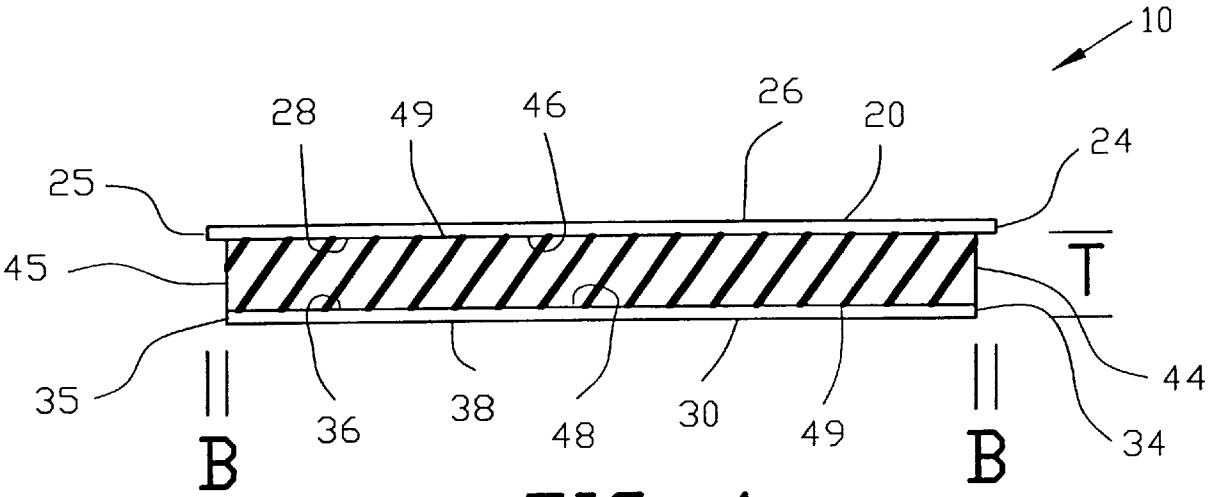
FIG. 4 is a magnified sectional view along line 4—4 in FIG. 1.
Figure 5:
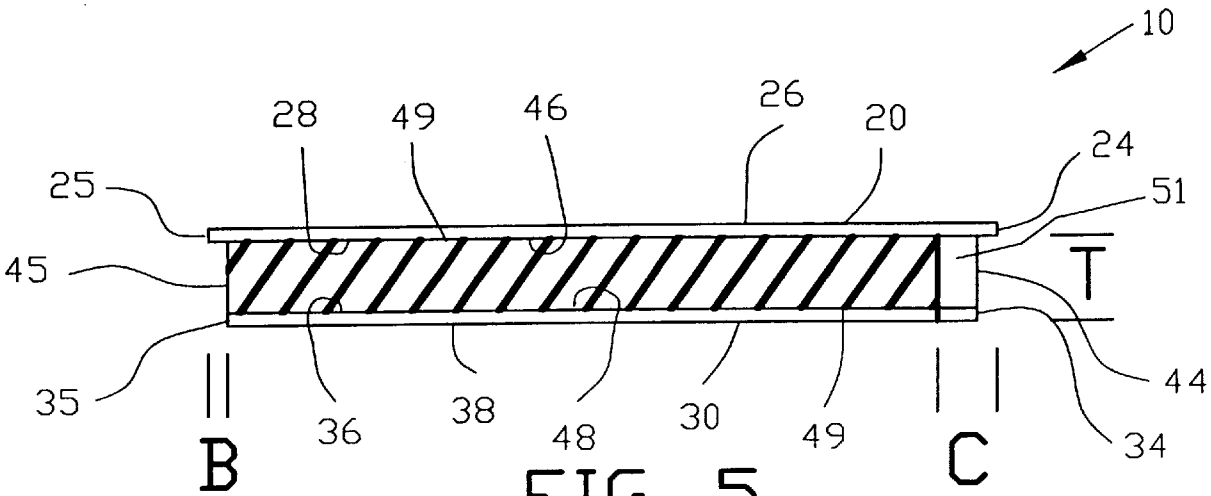
FIG. 5 is a magnified sectional view along line 5—5 in FIG. 1.

FIGS. 4 and 5 are magnified sectional views along line 4—4 and line 5—5 in FIG. 1. The upper sheet member 20 is defined between a first and a second end 21 and 22 and a first and a second side 24 and 25. The upper sheet member 20 has a top surface 26 and a bottom surface 28. Preferably, the upper sheet member 20 is a substantially rigid material such as wood or any other suitable material.

The lower sheet member 30 is defined between a first and a second end 31 and 32 and a first and a second side 34 and 35. The lower sheet member 30 has a top surface 36 and a bottom surface 38. Preferably, the lower sheet member 30 is a substantially rigid material such as wood or any other suitable material.

The composite panel 10 includes an insulating intermediate member 40 interposed between the upper sheet member 20 and the lower sheet member 30. The insulating intermediate member 40 is defined between a first and a second end 41 and 42 and a first and a second side 44 and 45. The insulating intermediate member 40 has a top surface 46 and a bottom surface 48. Preferably, the insulating intermediate member 40 is substantially rigid closed cell foam such as styrofoam or the like.

The upper sheet member 20 and the lower sheet member 30 are secured to the intermediate insulating member 40 to form a lamination. The bottom surface 28 of the upper sheet member 20 is secured to the top surface 46 of the intermediate insulating member 40. The top surface 36 of the lower sheet member 30 is secured to the bottom surface 48 of the intermediate insulating member 40. Preferably, the upper sheet member 20 and the lower sheet member 30 are bonded by an adhesive 49 to the intermediate insulating member 40 to form the lamination.

As best shown in FIGS. 1 and 3, the ends 21 and 22 of the upper sheet member 20 overhang adjacent ends 31 and 32 of the lower sheet member 30 by a distance A. Similarly, the ends 21 and 22 of the upper sheet member 20 overhangs adjacent ends 41 and 42 of the intermediate insulating member 40 by a distance A.

As best shown in FIGS. 3–5 the sides 24 and 25 of the upper sheet member 20 overhang adjacent sides 34 and 35 of the lower sheet member 30 by a distance B. Similarly, the sides 24 and 25 of the upper sheet member 20 overhangs adjacent sides 44 and 45 of the intermediate insulating member 40 by a distance B.

A first and a second notch 51 and 52 is defined in the lower sheet member 30 and in the intermediate insulating member 40. The upper sheet member 20 overhangs the first and second notches 51 and 52 defined in the lower sheet member 30 and the intermediate insulating member 40 by a distance C.

The composite panel 10 defines a panel thickness T. The panel thickness T is defined as the distance between the bottom surface 28 of the upper sheet member 20 and the bottom surface 38 of the lower sheet member 30.

Figure 6:
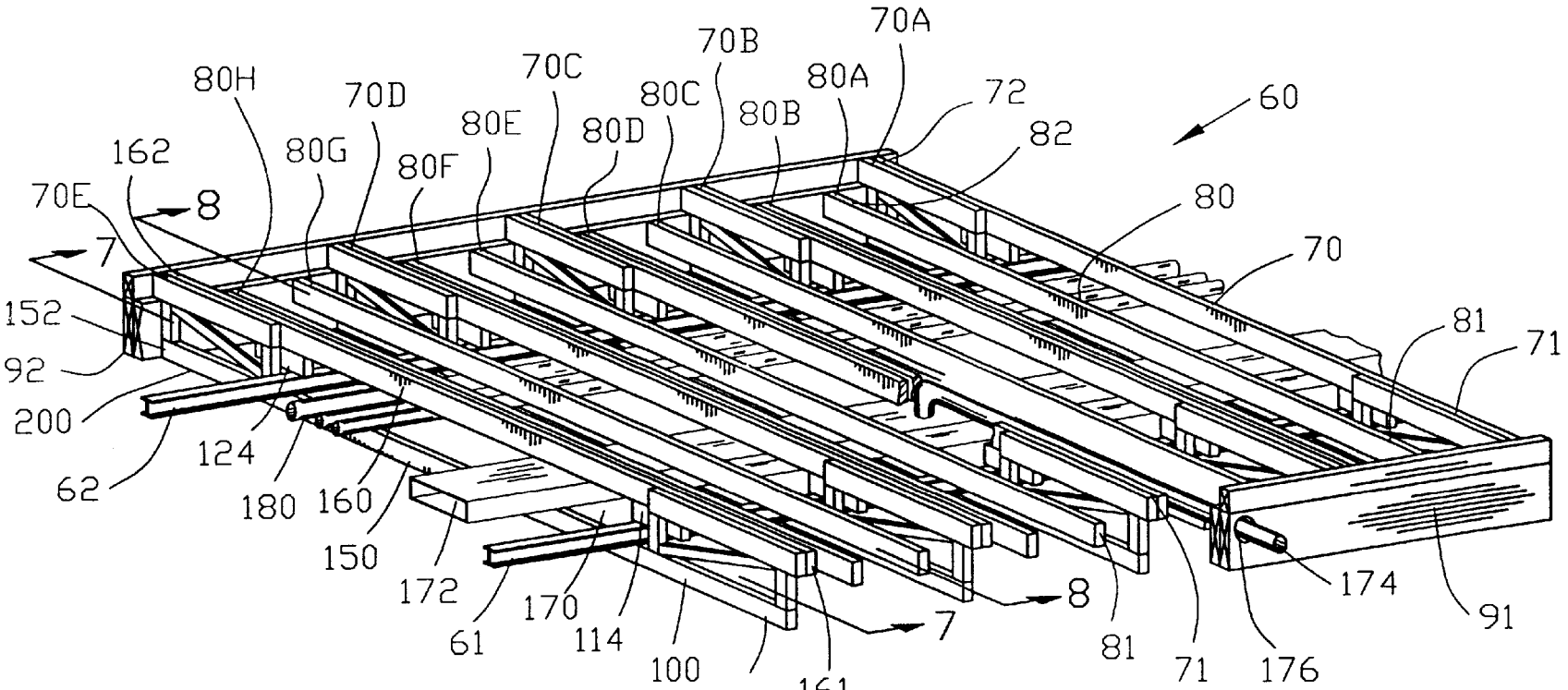
FIG. 6 is an isometric view of a building structure illustrating plural longitudinally extending beams with the plurality of major transverse beams and the plurality of minor transverse beams disposed thereon.

FIG. 6 is an isometric view of a frame 60 for a building structure. The frame 60 comprises a first and a second longitudinally extending beam 61 and 62 extending in a substantially parallel relationship. Although the first and second longitudinally extending beams 61 and 62 have been shown as metallic steel I-beams 61 and 62, it should be understood that the first and second longitudinally extending beams 61 and 62 may be fashioned from wood or any other suitable material.

When the frame 60 is used in a manufactured home, a plurality of removable wheel assemblies (not shown) may be removably affixed to the first and second longitudinally extending beams 61 and 62 for enabling the manufactured home 10 to be towed to a building site. Upon reaching the building site, the plurality of removable wheel assemblies (not shown) may be removed and the manufactured home may be permanently mounted at the building site.

The frame 60 comprises a plurality of major transverse beams 70 shown as major transverse beams 70A–70E disposed upon the first and second longitudinal extending beams 61 and 62. The plurality of major transverse beams 70A–70E are oriented substantially perpendicular to the first and second longitudinal extending beams 61 and 62. Although each of the major transverse beams 70 has been shown as a wood beam, it should be understood that the major transverse beams 70 may be fashioned from any other suitable material.

Each of the major transverse beams 70A–70E comprises a first and a second truss portion 100 and 200, a lower support 150 and an upper support 160. The lower support 150 extends between a first and a second end 151 and 152. Similarly, the upper support 160 extends between a first and a second end 161 and 152.

The frame 60 comprises a plurality of minor transverse beams 80 shown as minor transverse beams 80A–80H. The plurality of minor transverse beams 80A–80H are oriented substantially perpendicular to the first and second longitudinally extending beams 61 and 62. Although each of the minor transverse beams 80 has been shown as wood beams, it should be understood that the minor transverse beams 80 may be fashioned from any other suitable material.

At least one of the plurality of minor transverse beams 80 is interposed between adjacent major transverse beams 70. Preferably, the plurality of minor transverse beams 80 are uniformly disposed between adjacent major transverse beams 70. In this example, two minor transverse beams 80 are interposed between adjacent major transverse beams 70.

Each of the plurality of major transverse beams 70 comprises a first and a second end 71 and 72 extending outwardly with the first and second ends 71 and 72 overhanging the first and second longitudinally extending beams 61 and 62. In a similar manner, each of the plurality of minor transverse beams 80 comprises a first and a second end 81 and 82 extending outwardly with the first and second ends 81 and 82 overhanging the first and second longitudinally extending beams 61 and 62.

A first and a second peripheral beam 91 and 92 is respectively connected to the first and second ends 71 and 72 of each of the plurality of major transverse beams 70. Similarly, the first and second peripheral beams 91 and 92 are respectively connected to the first and second ends 81 and 82 of each of the plurality of minor transverse beams 80.

A void 170 is located between the first and second longitudinally extending beams 61 and 62. The void 170 is adapted to receive a primary air duct 172, a secondary air duct 174 and pipes or conduits 180 such as plumbing pipes and electrical conduits or wires or the like. The secondary air duct 174 extends through an aperture 176 defined within the first peripheral beam 91.

The first and second ends 71 and 72 of the plurality of major transverse beams 70 and the first and second ends 81 and 82 of the plurality of minor transverse beams 80 support the walls and the roof (not shown) of the building structure. Furthermore, first and second ends 71 and 72 of the plurality of major transverse beams 70 and the first and second ends 81 and 82 of the plurality of minor transverse beams 80 support any load deposited on the roof (not shown) such as snow, ice or the like. A complete explanation of this support may be found on my previously cited prior United States Letters Patent.

Figure 7:
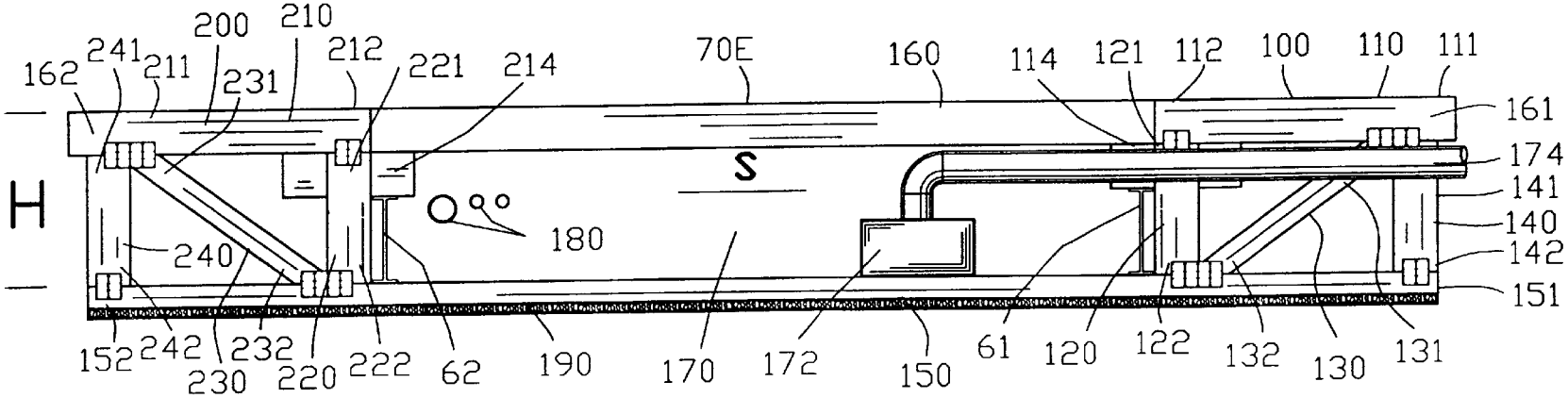
FIG. 7 is a magnified sectional view along line 7—7 in FIG. 6.

FIG. 7 is a magnified sectional view along line 7—7 in FIG. 6 illustrating the major transverse beam 70 comprising the first and second truss portions 100 and 200, the lower support 150 and the upper support 160. A plurality of first and second filler blocks 114 and 214 are located on the first and second longitudinally extending beams 61 and 62 for spacing and supporting the upper supports 160 from the first and second longitudinally extending beams 61 and 62. As will be described in greater detail hereinafter, the first and second filler blocks 114 and 214 cooperate with the lower supports 150 to engage opposed sides of the first and second longitudinally extending beams 61 and 62.

The first truss portion 100 comprises a first upper member 110 having a first and a second end 111 and 112. The first upper member 110 is positioned parallel to and in engagement with the first end 161 of the upper support 160. After assembly, the first upper member 110 is secured to the first end 161 of the upper support 160 to secure the first truss portion 100 to the upper support 160. The first truss portion 100 may be secured to the upper support 160 by an adhesive or mechanical fasteners such as nail, screws, bolts or any appropriate fastener.

The first truss portion 100 comprises a first inner depending member 120 having a first and a second end 121 and 122. The first end 121 of the first inner depending member 120 is connected to the first upper member 110 in proximity to the second end 112 thereof. The first inner depending member 120 extends downwardly from the first upper member 110 and preferably extends downward in a substantially vertical direction. The first truss portion 100 comprises a first brace 130 having a first and a second end 131 and 132.

The first truss portion 100 comprises a first outer depending member 140 having a first and a second end 141 and 142.

The first end 141 of the first outer depending member 140 is connected to the first upper member 110 in proximity to the first end 111 thereof. The first outer depending member 140 extends downwardly from the first upper member 110 preferably in a substantially vertical direction.

Preferably, the lower support 150 of the major transverse beam 70 is positioned to extend in a substantially horizontal direction. The first end 151 of the lower support 150 is connected to the second end 142 of the first outer depending member 140. The second end 122 of the first inner depending member 120 extends downwardly from the first upper member 110 and is connected to the lower support 150. Preferably, the lower support 150 of the first truss portion 100 is positioned to extend in a substantially horizontal direction.

The first end 131 of the first brace 130 is connected in proximity to the interconnection of the first end 111 of the first upper member 110 with the first end 141 of the first outer depending member 140. The second end 132 of the first brace 130 is connected in proximity to the interconnection of the second end 122 of the first inner depending member 120 and the lower support 150.

Preferably, the first end 131 of the first brace 130 is connected to the first end 111 of the first upper member 110 and is simultaneously connected to the first end 141 of the first outer depending member 140. Similarly, the second end 132 of the first brace 130 is connected to second end 122 of the first inner depending member 120 and is simultaneously connected to the lower support 150. The first brace 130 of the first truss portion 100 extends angularly relative to the first upper member 110 and the lower support 150.

The first filler block 114 is secured to the first inner depending member 121 by suitable means such as adhesive and or mechanical fasteners. The first filler block 114 and the lower support 150 engage opposed sides of the first longitudinally extending beam 61. A secondary fastener (not shown) may interconnect the first longitudinally extending beam 61 with the first truss portion 100.

The second truss portion 200 comprises a second upper member 210 having a first and a second end 211 and 212. The second upper member 210 is positioned parallel to and in engagement with the second end 162 of the upper support 160. After assembly, the second upper member 210 is secured to the second end 162 of the upper support 160 to secure the second truss portion 200 to the upper support 160. The second truss portion 200 may be secured to the upper support 160 by an adhesive or mechanical fasteners such as nail, screws, bolts or any appropriate fastener.

The second truss portion 200 comprises a second inner depending member 220 having a first and a second end 221 and 222. The first end 221 of the second inner depending member 220 is connected to the second upper member 210 in proximity to the second end 212 thereof. The second inner depending member 220 extends downward from the second upper member 210 and preferably extends downward in a substantially vertical direction. The second truss portion 200 comprises a second brace 230 having a first and a second end 231 and 232.

The second truss portion 200 comprises a second outer depending member 240 having a first and a second end 241 and 242. The first end 241 of the second outer depending member 240 is connected to the second upper member 210 in proximity to the first end 211 thereof. The second outer depending member 240 extends downwardly from the second upper member 210 preferably in a substantially vertical direction.

The second end 152 of the lower support 150 is connected to the second end 242 of the second outer depending member 240. The second end 222 of the second inner depending member 220 extends downwardly from the second upper member 210 and is connected to the lower support 150.

The first end 231 of the second brace 230 is connected in proximity to the interconnection of the first end 211 of the second upper member 210 with the first end 241 of the second outer depending member 240. The second end 232 of the second brace 230 is connected in proximity to the interconnection of the second end 222 of the second inner depending member 220 and the lower support 150.

Preferably, the first end 231 of the second brace 230 is connected to the first end 211 of the second upper member 210 and is simultaneously connected to the first end 241 of the second outer depending member 240. Similarly, the second end 232 of the second brace 230 is connected to the second end 252 of the second inner depending member 220 and is simultaneously connected to the lower support 150. The second brace 230 of the second truss portion 200 extends angularly relative to the second upper member 210 and the lower support 150.

The second filler block 214 is secured to the second inner depending member 221 by suitable means such as adhesive and or mechanical fasteners. The second filler block 214 and the lower support 150 engage opposed sides of the second longitudinally extending beam 62. A secondary fastener (not shown) may interconnect the second longitudinally extending beam 62 with the second truss portion 200. Preferably, the first and second truss portions 100 and 200 and the lower support 150 are made from a wood material being interconnected by a plurality of mechanical fasteners.

Each of the major transverse beams 70 defines a major vertical height H. The major vertical height H of the major transverse beams 70 is defined by the distance between the bottom of the first and second longitudinally extending beams 61 and 62 and the top of the major transverse beams 70. The first and second support blocks 114 and 214 space the major transverse beams 70 from the top of the first and second longitudinally extending beams 61 and 62 for creating a space S.

Figure 8:
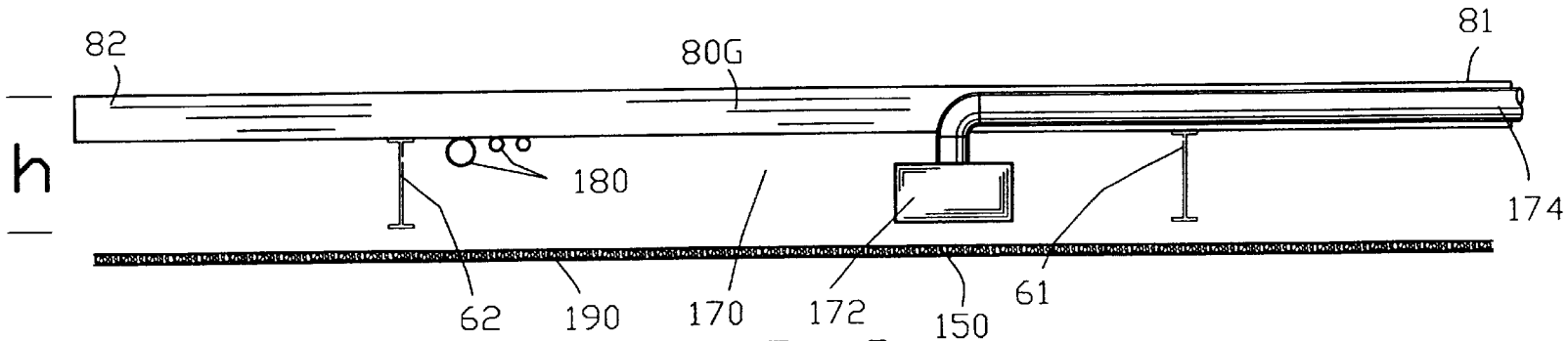
FIG. 8 is a magnified sectional view along line 8—8 in FIG. 6.

FIG. 8 is a magnified sectional view along line 8—8 in FIG. 6 illustrating the minor transverse beams 80. In this example of the invention, each of the plurality of minor transverse beams 80 are shown as a wood beams disposed directly upon the first and second longitudinally extending beams 61 and 62. Each of the minor transverse beams 80 defines a minor vertical height h. The minor vertical height h of the minor transverse beams 80 is defined by the distance between the bottom of the first and second longitudinally extending beams 61 and 62 and the top of the minor transverse beams 80.

The major vertical height H of the major transverse beams 70 is greater than the minor vertical height h of the minor transverse beams 80. Preferably, the major vertical height H of the major transverse beams 70 is greater than the minor vertical height h of the minor transverse beams 80. The difference between the major vertical height H and the minor vertical height h is equal to the space S created by the first and second support blocks 114 and 214. Preferably, the space S is equal to the panel thickness T of the composite panel 20.

The void 170 defined between the first and second inner depending members 120 and 220 of the first and second truss portions 100 and 200 receives the primary air duct 172, the secondary air duct 174 and the pipes or conduits 180 such as plumbing pipes and electrical conduits or wires or the like.

The secondary air duct 174 extends through the aperture 176 defined within the first peripheral beam 91. The secondary air duct 174 extends through the space created by the first and second support blocks 114 and 214 to pass over the first longitudinally extending beam 61. A secondary air duct or any other pipe or conduit may extend through the space created by the first and second support blocks 114 and 214 to pass over the second longitudinally extending beam 62.

Figure 9:
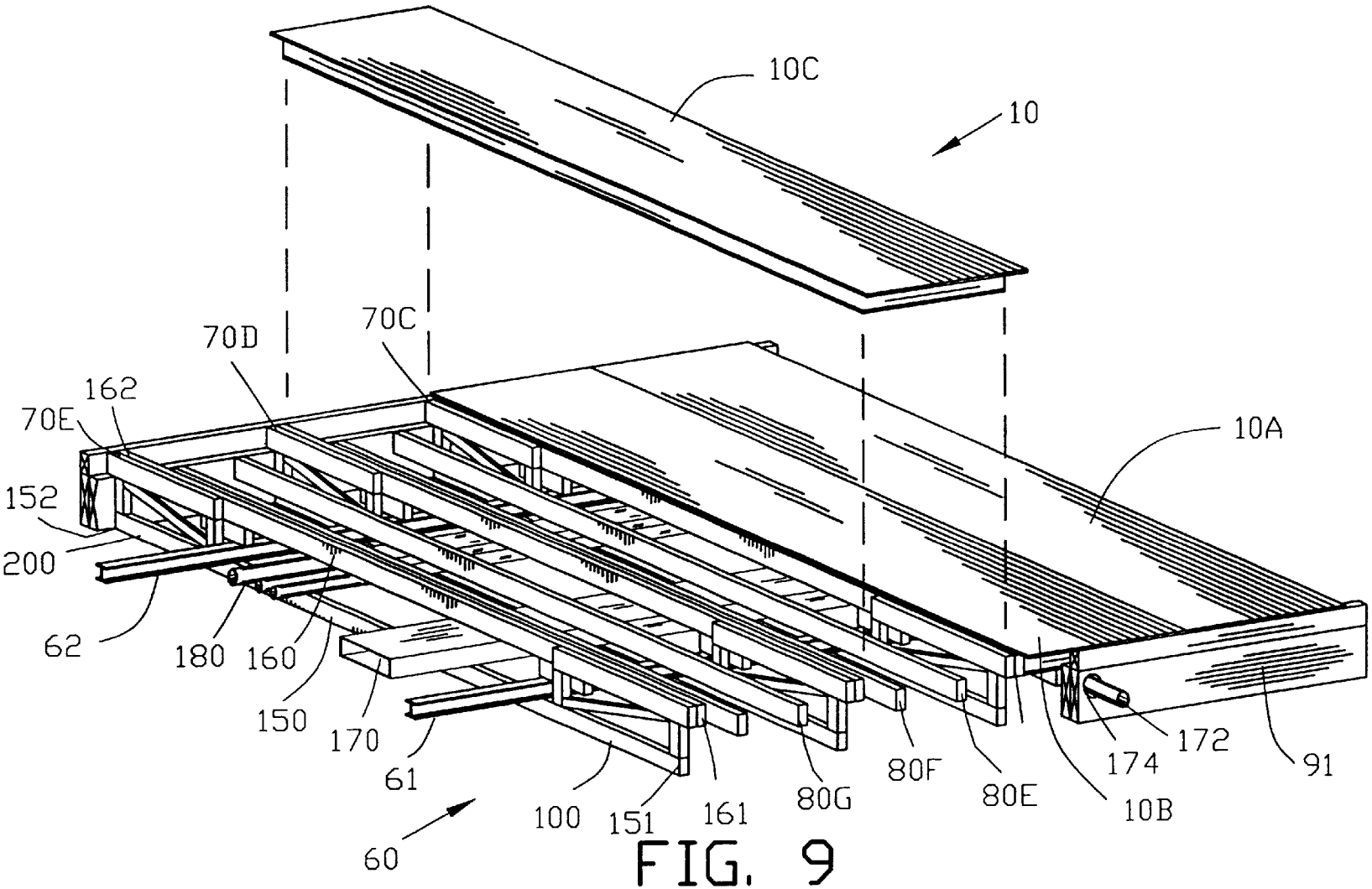
FIG. 9 is a view similar to FIG. 6 illustrating the installation of a plurality of the composite panels.

FIG. 9 is an isometric view similar to FIG. 6 illustrating the installation of a plurality of composite panels 10 shown as composite panels 10A–10C. The plurality of composite panels 10 are positioned between adjacent major transverse beams 70. More specifically, the composite panels 10A are positioned between adjacent major transverse beams 70A and 70B. The composite panels 10B are positioned between adjacent major transverse beams 70B and 70C. The composite panels 10C are being positioned above adjacent major transverse beams 70C and 70D.

Figure 10:
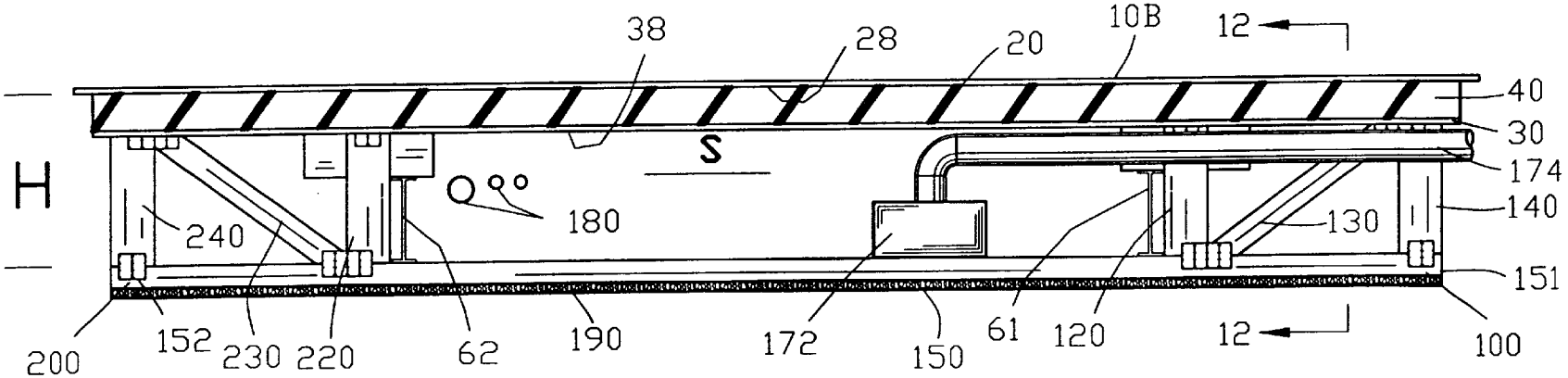
FIG. 10 is a view similar to FIG. 7 illustrating the installation of the composite panel.
Figure 11:
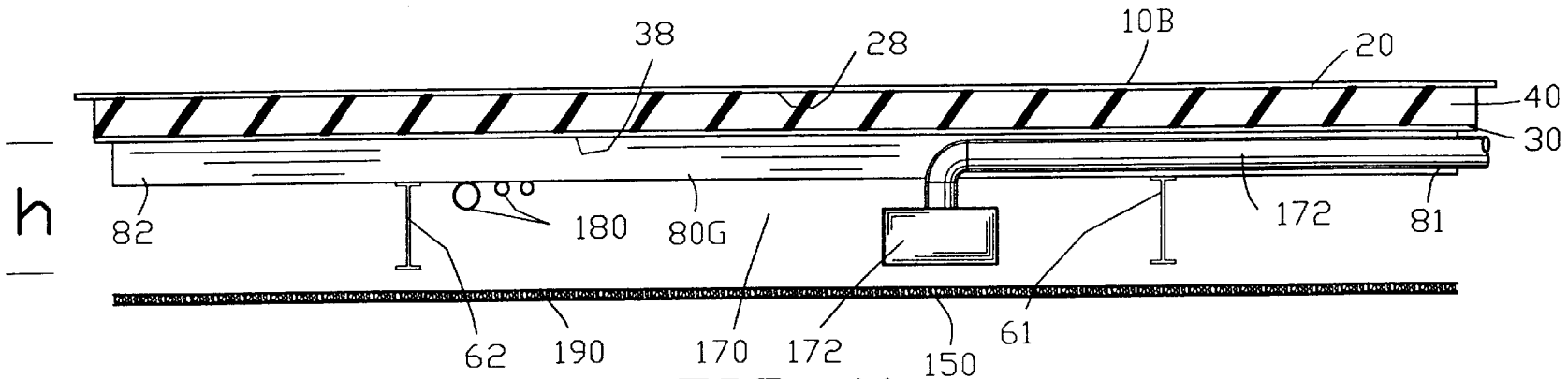
FIG. 11 is a view similar to FIG. 8 illustrating the installation of the composite panel.

FIGS. 10 and 11 are views similar to FIGS. 7 and 8 illustrating the major and minor transverse beams 70 and 80 supporting the composite panels 10B. The panel thickness T between the bottom surface 28 of the upper sheet member 20 and the bottom surface 38 of the lower sheet member 30 is equal to the space created by the first and second support blocks 114 and 214. The bottom surface 38 of the lower sheet member 30 is supported by the minor transverse beams 80. The bottom surface 28 of the upper sheet member 20 is supported by the major transverse beams 70. The secondary air duct 174 extends through the space created by the first and second support blocks 114 and 214 between the bottom surface 38 of the lower sheet member 30 and the top of the first longitudinally extending beam 61.

The ends 21 and 22 of the upper sheet member 20 overhang the adjacent ends 31 and 32 of the lower sheet member 30 and the adjacent ends 41 and 42 of the intermediate insulating member 40 by a distance A. The overhang distance A is sufficient to enable the ends 21 and 22 of the upper sheet member 20 to overhang the first and second peripheral beams 91 and 92. Preferably, the overhanging ends 21 and 22 of the upper sheet member 20 are secured to the first and second peripheral beams 91 and 92 by fastening means such as a plurality of mechanical fasteners such as nails, screws, staples or the like.

Figure 12:
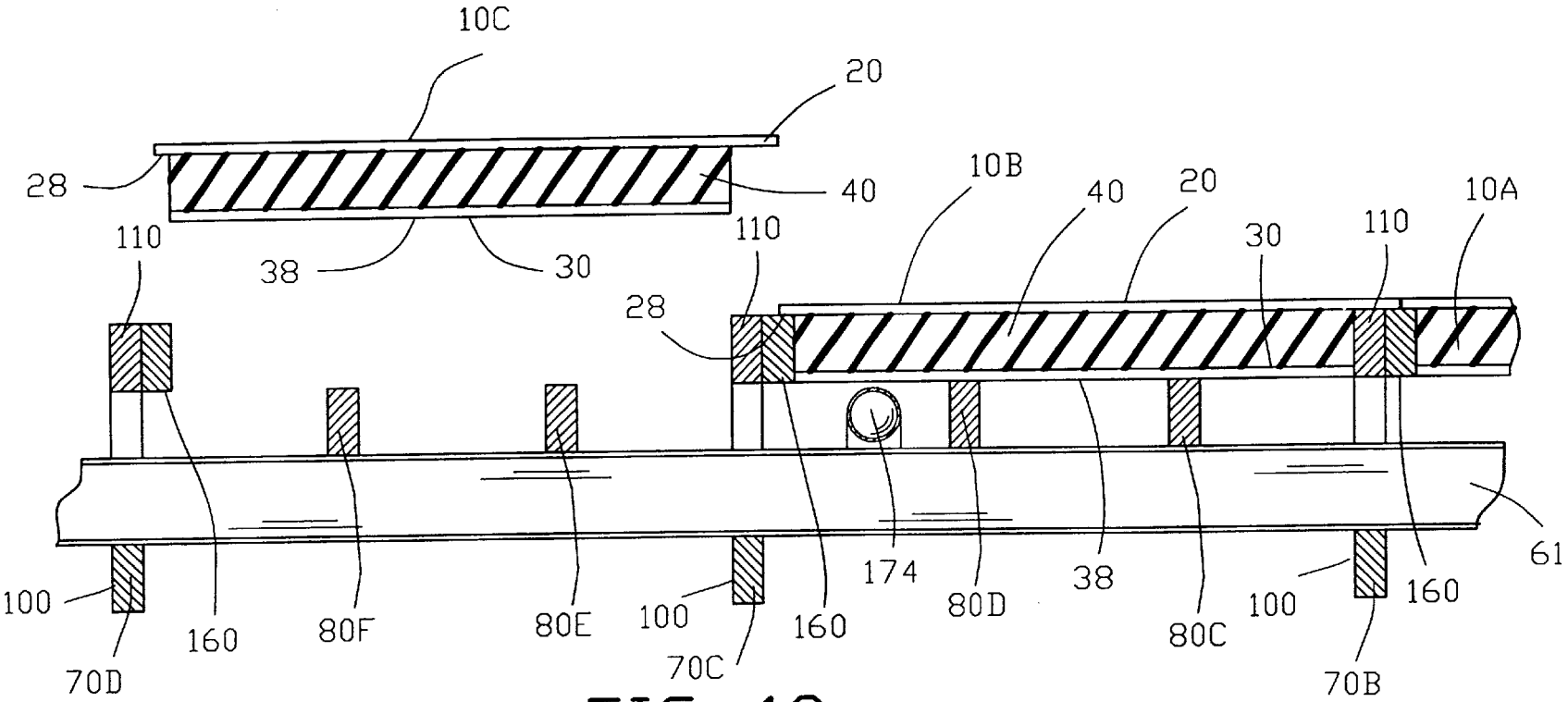
FIG. 12 is a magnified sectional view along line 12—12 in FIG. 10.

FIG. 12 is a magnified sectional view along line 12—12 in FIG. 10 illustrating the installation of composite panels 10A–10C. The composite panels 10A are positioned between adjacent major transverse beams 70A and 70B. The composite panels 10B are positioned between adjacent major transverse beams 70B and 70C. The composite panels 10C are being positioned above adjacent major transverse beams 70C and 70D.

The sides 24 and 25 of the upper sheet member 20 overhang the adjacent sides 34 and 35 of the lower sheet member 30 and the adjacent sides 44 and 45 of the intermediate insulating member 40 by a distance B. The overhang distance B is sufficient to enable the sides 24 and 25 of the upper sheet member 20 to overhang approximately one-half of the adjacent upper supports 160.

The upper sheet member 20 overhangs the first and second notches 51 and 52 defined in the lower sheet member 30 and in the intermediate insulating member 40 by a distance C. The distance C is sufficient to accommodate for the first upper member 110 of the first truss portion 100. The second upper member 200 is accommodated by the second notch 52 in a similar fashion.

Preferably, the overhanging sides 24 and 25 of the upper sheet member 20 are secured to the adjacent upper supports 160 by fastening means such as a plurality of mechanical fasteners such as nails, screws, staples or the like.

Figure 13:
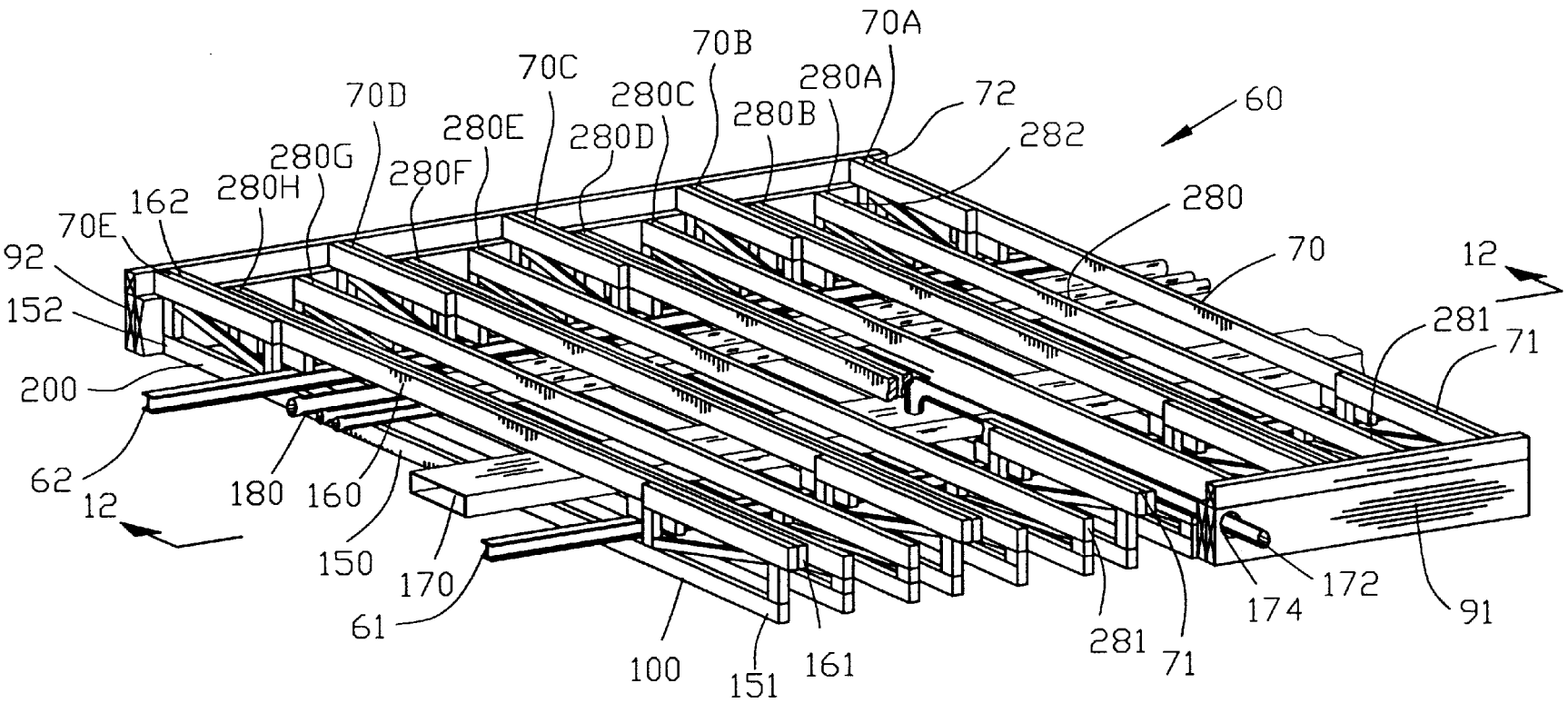
FIG. 13 is an isometric view similar to FIG. 6 with a plurality of major transverse beams and a plurality of minor transverse beams shown as major and minor trusses.

FIG. 13 is an isometric view similar to FIG. 6 with a plurality of major transverse beams 70 and a plurality of minor transverse beams 280. In this embodiment of the invention, each of the plurality of minor transverse beams 280 includes a first and a second minor truss portion for adding additional strength to the building structure. The minor truss portions may be substantially identical to the major truss portions shown in FIGS. 7 and 10.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A composite floor system for a building structure, comprising:

a plurality of major transverse beams;

a minor transverse beam;

each of said major transverse beams having a greater vertical height than said minor transverse beam;

said minor transverse beam being interposed between adjacent major transverse beams;

a composite panel having an upper sheet member and a lower sheet member with an insulating intermediate member being interposed between said upper sheet member and said lower sheet member;

said composite panel being positioned between adjacent major transverse beams with said major transverse beams supporting said upper sheet member and with said interposed minor transverse beam supporting said lower sheet member; and a fastener for affixing said composite panel to one of said transverse beams.

2. A composite floor system for a building structure as set forth in claim 1, wherein each of said major transverse beams comprises a truss.

3. A composite floor system for a building structure as set forth in claim 1, wherein each of said major transverse beams comprises a major wood beam.

4. A composite floor system for a building structure as set forth in claim 1, wherein said minor transverse beam comprises a minor wood beam.

5. A composite floor system for a building structure as set forth in claim 1, wherein said composite panel defines a panel thickness between said upper sheet member and lower sheet member; and said vertical height of said major transverse beam being greater than said vertical height of said minor transverse beam by an amount commensurate with said panel thickness of said composite panel.

6. A composite floor system for a building structure as set forth in claim 1, including a plurality of minor transverse beams being uniformly disposed between adjacent major transverse beams.

7. A composite floor system for a building structure as set forth in claim 1, wherein each of said upper sheet member and said lower sheet member are wood.

8. A composite floor system for a building structure as set forth in claim 1, wherein said insulating intermediate member is a substantially rigid foam insulating member.

9. A composite floor system for a building structure as set forth in claim 1, wherein said insulating intermediate member is a substantially rigid foam insulating member; and said upper sheet and said lower sheet being adhesively bonded to said intermediate insulating member to form a lamination.

10. A composite floor system for a building structure as set forth in claim 1, wherein said upper sheet member of said composite panel overhangs adjacent sides of said lower sheet member for enabling said upper sheet member to rest upon said adjacent major transverse beams.

11. A composite floor system for a building structure as set forth in claim 1, wherein said upper sheet member of said composite panel overhangs adjacent sides of said lower sheet member for enabling said upper sheet member to rest upon said adjacent major transverse beams; and said fastener comprising a plurality of mechanical fasteners for affixing said upper sheet member to said adjacent major transverse beams.

12. A composite floor system for a building structure as set forth in claim 1, wherein said fastener comprises a plurality of mechanical fasteners for affixing said upper sheet member to said adjacent major transverse beams.

13. A composite floor system for a building structure as set forth in claim 1, wherein said fastener comprises a plurality of nail fasteners for affixing said upper sheet member to said adjacent major transverse beams.

14. A composite insulated floor system for a building structure, comprising:

a first and a second longitudinally extending beam;

a plurality of major transverse beams disposed upon said first and second longitudinal extending beams and oriented substantially perpendicular thereto;

a plurality of minor transverse beams disposed upon said first and second longitudinally extending beams and oriented substantially perpendicular thereto;

at least one of said minor transverse beams being interposed between adjacent major transverse beams;

a plurality of composite panels with each of said composite panels having an upper sheet member and a lower sheet member with an insulating intermediate member disposed therebetween;

each of said composite panels defining a panel thickness between said upper sheet member and lower sheet member;

each of said major transverse beam having a greater vertical height than each of said minor transverse beams by an amount commensurate with said panel thickness of said composite panel;

said plurality of composite panels being positioned between adjacent major transverse beams with said major transverse beams supporting said upper sheet member and with said lower sheet member supporting said lower sheet member; and a fastener for affixing said plurality of composite panel to said plurality of transverse beams.

15. A composite insulated floor system for a building structure as set forth in claim 14, wherein each of said first and second longitudinally extending beam is a metallic I-beam.

16. A composite insulated floor system for a building structure as set forth in claim 14, wherein said insulating intermediate member is a substantially rigid foam insulating member; and said upper sheet and said lower sheet being adhesively bonded to said intermediate insulating member to form a lamination.

17. A composite insulated floor system for a building structure as set forth in claim 14, wherein said upper sheet member of said composite panel overhangs adjacent sides of said lower sheet member and said intermediate insulating member for enabling said upper sheet member to rest upon said adjacent major transverse beams.

18. A composite insulated floor system for a building structure as set forth in claim 15, wherein said upper sheet member of said composite panel overhangs adjacent sides of said lower sheet member and said intermediate insulating member for enabling said upper sheet member to rest upon said adjacent major transverse beams; and said fastener comprising a plurality of mechanical fasteners for affixing said upper sheet member to said adjacent major transverse beams.

19. A composite insulated floor system for a building structure as set forth in claim 14, wherein said fastener comprises a plurality of nail fasteners for affixing said upper sheet member to said adjacent major transverse beams.

* * * * *